US006729509B1

(12) United States Patent
Fabian

(10) Patent No.: US 6,729,509 B1
(45) Date of Patent: May 4, 2004

(54) MINI-BLIND HOLDER AND CLOTHES HANGER COMBINATION

(76) Inventor: Sharon L. Fabian, 121 Beverly La., Wintersville, OH (US) 43953

( * ) Notice: Subject to any disclaimer, the term of this patent is extended or adjusted under 35 U.S.C. 154(b) by 0 days.

(21) Appl. No.: 10/192,878

(22) Filed: Jul. 8, 2002

(51) Int. Cl.[7] ..... A41D 27/22
(52) U.S. Cl. ..... 223/85
(58) Field of Search ..... 223/85, 90, 96, 223/91; 15/268, 220.3; 211/106.01; 160/34, 368.1, 405; 206/289; 248/200, 214, 215

(56) References Cited

U.S. PATENT DOCUMENTS 5,286,956 A * 2/1994 Mochizuki ..... 235/432

* cited by examiner

*Primary Examiner*—John J. Calvert
*Assistant Examiner*—James G Smith

(57) ABSTRACT

A mini-blind holder and clothes hanger combination for holding mini-blinds for cleaning and drying includes a hanger that comprises a rod and a pair of angled members. Each of the angled members has a first end attached to the rod and a second end attached together such that a loop is defined. A hook is rotatably attached to a juncture of the angled members and extends in a direction away from the rod. A pair of hanging members for removably attaching to a mini-blind is attached to the rod. The hanging members are spaced from each other. Each of the hanging members is adapted for swiveling with respect to the rod.

13 Claims, 3 Drawing Sheets

MINI-BLIND HOLDER AND CLOTHES HANGER COMBINATION

BACKGROUND OF THE INVENTION

1. Field of the Invention

The present invention relates to mini-blind cleaning racks and more particularly pertains to a new mini-blind cleaning rack for holding mini-blinds for cleaning and drying.

2. Description of the Prior Art

The use of mini-blind cleaning racks is known in the prior art. U.S. Pat. No. 4,934,015 describes an adjustable vertical rack for holding mini-blinds in a vertical orientation for cleaning purposes. Another type of mini-blind cleaning rack is U.S. Pat. No. 2,875,971 which includes a vertical rod having an upper end having a horizontal rod attached thereto with gripping members for attachment to mini-blinds. The prior art is replete with such examples.

While these devices fulfill their respective, particular objectives and requirements, the need remains for a device which is simpler to use and set up. The devices in the prior art typically come in multiple pieces which need to be put together before use and which take up a considerable amount of space.

SUMMARY OF THE INVENTION

The present invention meets the needs presented above by offering a hanger-type device which may be hung from a shower rod without any needed pre-assembly.

Still yet another object of the present invention is to provide a new mini-blind cleaning rack that is easily storable and relatively small in structure.

Even still another object of the present invention is to provide a new mini-blind cleaning rack that has a dual use as a clothes hanger which allows the device to have continual use outside of the hanging of mini-blinds and also aids in the storage of the device.

To this end, the present invention generally comprises a hanger that includes a rod and a pair of angled members. Each of the angled members has a first end attached to the rod and a second end attached together such that a loop is defined. A hook is rotatably attached to a juncture of the angled members and extends in a direction away from the rod. A pair of hanging members for removably attaching to a mini-blind is attached to the rod. The hanging members are spaced from each other. Each of the hanging members is adapted for swiveling with respect to the rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
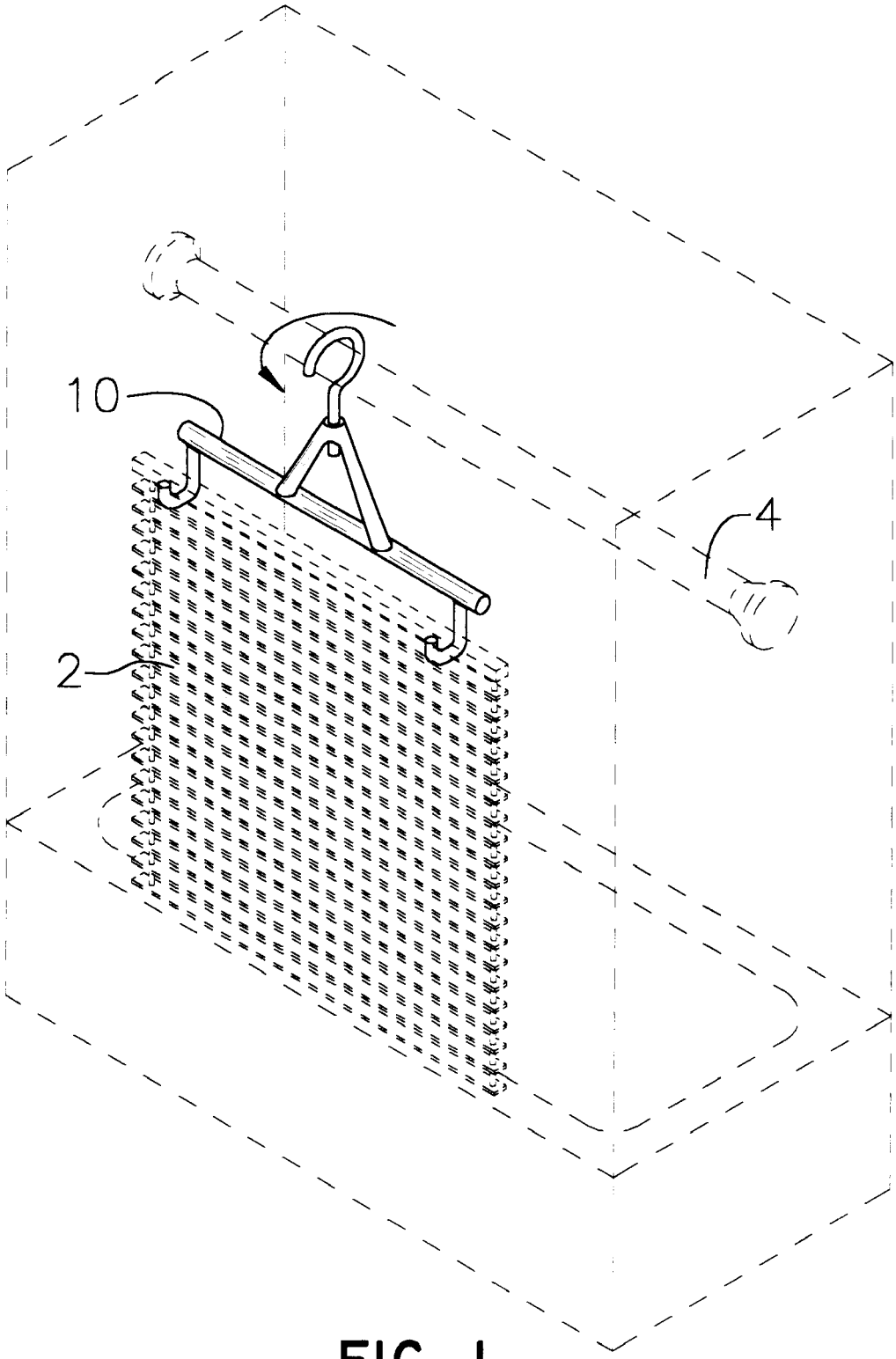
FIG. 1 is a schematic perspective view of a mini-blind holder and clothes hanger combination according to the present invention.
Figure 2:
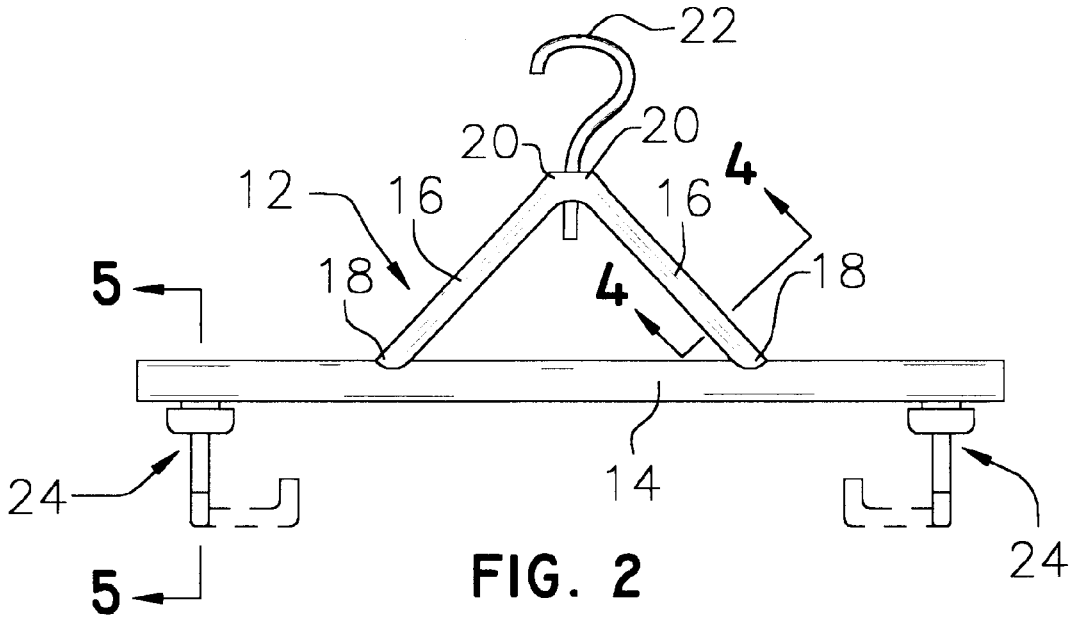
FIG. 2 is a schematic front view of the present invention.
Figure 3:
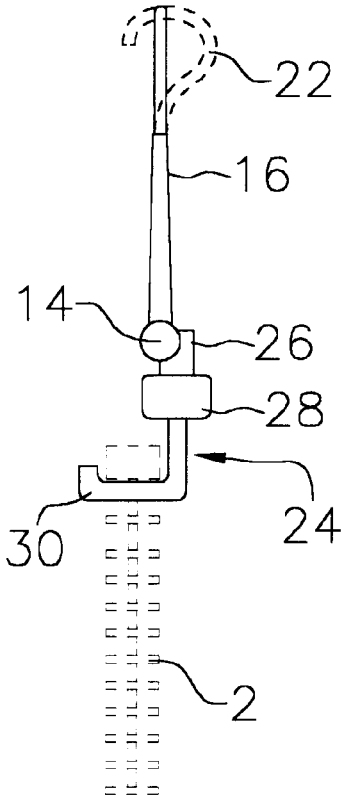
FIG. 3 is a schematic side view of the present invention.
Figure 4:
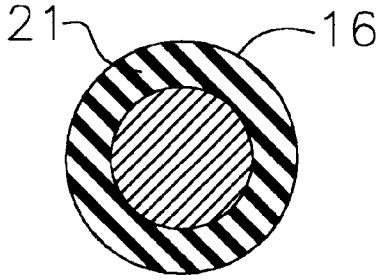
FIG. 4 is a schematic cross-sectional view taken along line 4—4 of FIG. 2 of the present invention.

With reference now to the drawings, and in particular to FIGS. 1 through 5 thereof, a new mini-blind cleaning rack embodying the principles and concepts of the present invention and generally designated by the reference numeral 10 will be described.

As best illustrated in FIGS. 1 through 5, mini-blind holder and clothes hanger combination 10 for holding a mini-blind 2 generally comprises a hanger 12 including a rod 14 and a pair of angled members 16. Each of the angled members 16 has a first end 18 attached to the rod 14 and a second end 20 attached together such that a loop is defined. A hook 22 is rotatably attached to a juncture of the second ends 20 of the angled members 16 and extends in a direction away from the rod 14. A resiliently elastic material 21 may coat the hanger 12.

A pair of hanging members 24 is attached to the rod 14. The hanging members 24 are spaced from each other. Each of the hanging members 24 includes a shaft 26 attached to the rod 14, a saddle 28 rotatably coupled to the shaft 26 and an engaging member 30 attached to the saddle 28. By this manner, the engaging member 30 may swivel with respect to the rod 14. The shaft 26 extends in a direction generally opposite of the angled members 16. A flange 32 is attached to and extends around a free end 34 of the shaft 26.

The saddle 28 has a first side 36, a second side 38 and a peripheral wall 40 extending between the first 36 and second 38 sides. A well 42 extends into first side 36. The well 42 has a bottom wall 44. A hole 46 extends into the bottom wall 44 of the well 42. A peripheral lip 48 is attached to the first side 36 and extends inward. The free end 32 of the shaft 26 is positioned in the well 42 such that the flange 32 is positioned between the lip 48 and the bottom wall 44 and so that the saddle 28 is rotatably coupled to the shaft 26.

The engaging member 30 is attached to and extends away from the saddle 28. The engaging member 30 includes a leg portion 50 attached to the second side 38 of the saddle 28. A foot portion 52 is attached to and extends away from the leg portion 50. The foot portion 52 has a bend 54 therein such that a free end 56 of the foot portion 52 extends upward. The engaging member 30 generally has a J-shaped configuration. The foot portion 52 is selectively positionable in a retracted position located generally in a plane of the rod 14 and the angled members 16 and an extended position orientated generally perpendicular to the plane.

A biasing member 58 biases the flange 32 away from the lip 48. The biasing member 58 comprises a spring positioned between the flange 32 and the lip 48. A pin 60 is attached to the free end 34 of the shaft 26. The pin 60 is located such that it may extend into the hole 46 when the engaging member 30 is in the retracted position. The biasing member 58 and pin 60 act as a locking means for selecting locking the engaging member 30 in the retracted position.

Figure 5:
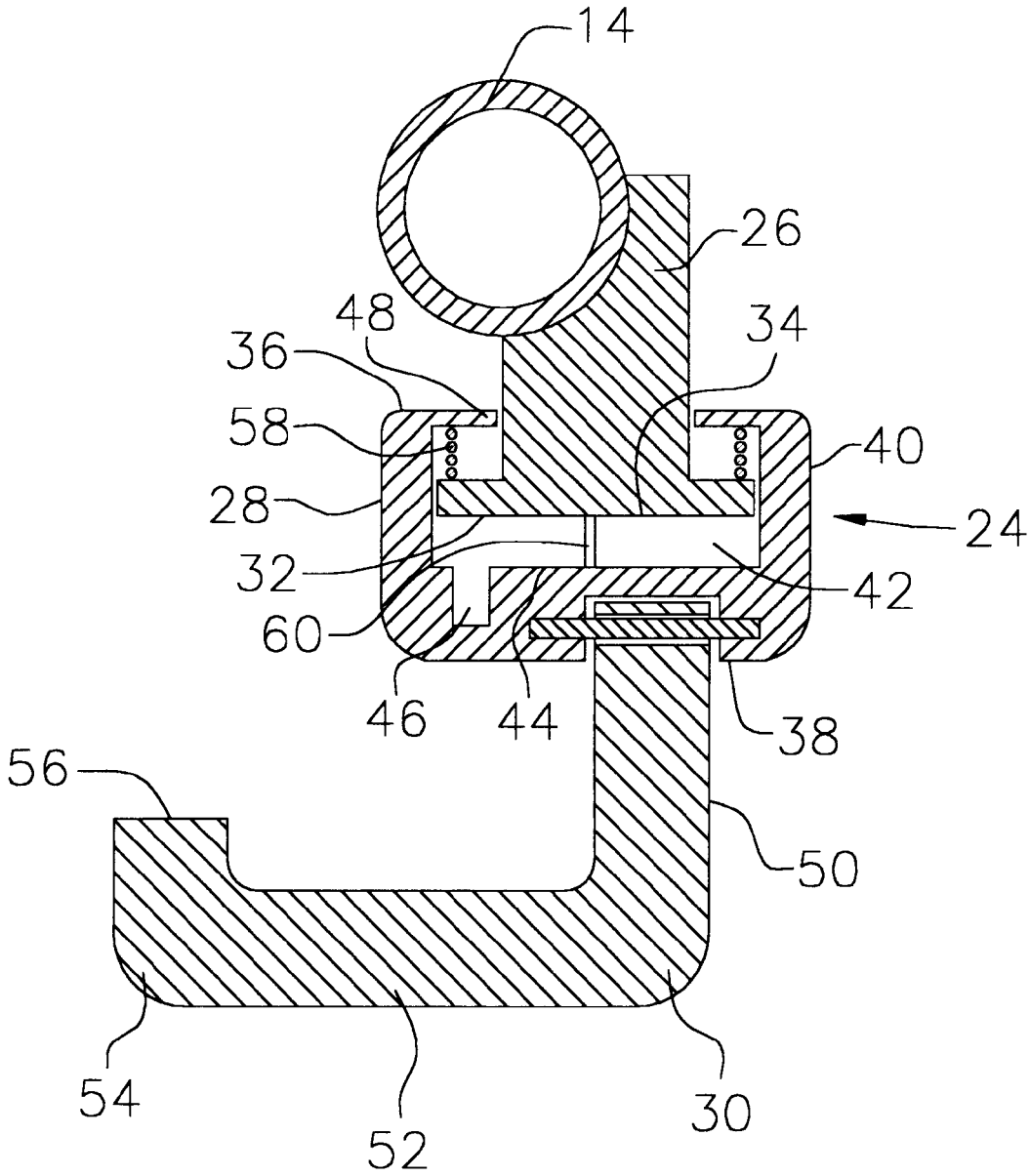
FIG. 5 is a schematic cross-sectional view taken along line 5—5 of FIG. 2 of the present invention.

In use, the device 10 is foremost designed for hanging mini-blinds 2 from a shower rod 4, or other such elongated member while the mini-blinds 2 dry after cleaning. To use the device 10, the user places the engaging members 30 in the extended position as depicted in FIG. 5 by pulling down on the saddle 28 and removing the pin 60 from the hole 46 so that the engaging members 30 may be rotated. The mini-blind 2 is then positioned on the device 10 as shown in FIG. 1 so that the mini-blind 2 may shed its water into a bathtub. When not in use, the engaging members 30 are placed in their retracted position and the device 10 may be used as a conventional clothes hanger. The locking means keeps the engaging members 30 in the retracted position so that they do not interfere with the hanging of clothes.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A combination mini-blind and clothes hanger device, said device comprising:

a hanger including a rod and a pair of angled members, each of said angled members having a first end attached to said rod and a second end attached together such that a loop is defined, a hook being rotatably attached to a juncture of said angled members and extending in a direction away from said rod;

a pair of hanging members for removably attaching to a mini-blind, each of said hanging members being attached to said rod, said hanging members being spaced from each other, each of said hanging members being adapted for swiveling with respect to said rod, each of said hanging members including an engaging member, each of said engaging members being selectively positioned within or extending outwardly of a plane of said rod and angled members; and a locking means for selectively locking each of said engaging members in a retracted position located generally within said plane of said rod and angled members.

2. The combination mini-blind and clothes hanger device as in claim 1, wherein each of each of said hanging members comprises:

a shaft being attached to said rod and extending in a direction generally opposite of said angled members, a flange being attached to and extending around a free end of said shaft;

a saddle having first side, a second side and a peripheral wall extending between said first and second sides, a well extending into first side, said well having a bottom wall, a peripheral lip being attached to said first side and extending inward, said free end of said shaft being positioned in said well such that said flange is positioned between said lip and said bottom wall and said saddle is rotatably coupled to said shaft; and said engaging member being attached to and extending away from said saddle.

3. The combination mini-blind and clothes hanger device as in claim 2, wherein said locking means includes:

said bottom wall of said well having a hole extending therein;

a biasing member for biasing said flange away from said lip; and a pin being attached to said free end of said shaft, said pin being located such that it may extend into said hole when said engaging member is in said retracted position.

4. The combination mini-blind and clothes hanger device as in claim 2, wherein said engaging member includes a leg portion being attached to said second side of said saddle, a foot portion being attached to and extending away from said leg portion, said foot portion having a bend therein such that a free end of said foot portion extends upward, wherein said engaging member generally has a J-shaped configuration, said foot portion being selectively positionable in a retracted position located generally in a plane of said rod and said angled members and an extended position orientated generally perpendicular to said plane.

5. The combination mini-blind and clothes hanger device as in claim 2, further including a biasing member for biasing said flange away from said lip.

6. The combination mini-blind and clothes hanger device as in claim 5, further including a pin being attached to said free end of said shaft, said pin being located such that it may extend into said hole when said engaging member is in a retracted position defined by said engaging member being generally located in a plane of said rod of and said angled members.

7. A combination mini-blind and clothes hanger device, said device comprising:

a hanger including a rod and a pair of angled members, each of said angled members having a first end attached to said rod and a second end attached together such that a loop is defined, a hook being rotatably attached to a juncture of said angled members and extending in a direction away from said rod;

a pair of hanging members for removably attaching to a mini-blind, each of said hanging members being attached to said rod, said hanging members being spaced from each other, each of said hanging members comprising;

a shaft being attached to said rod and extending in a direction generally opposite of said angled members, a flange being attached to and extending around a free end of said shaft;

a saddle having first side, a second side and a peripheral wall extending between said first and second sides, a well extending into first side, said well having a bottom wall, a hole extending into said bottom wall of said well, a peripheral lip being attached to said first side and extending inward, said free end of said shaft being positioned in said well such that said flange is positioned between said lip and said bottom wall and said saddle is rotatably coupled to said shaft;

an engaging member being attached to and extending away from said saddle, said engaging member including a leg portion being attached to said second side of said saddle, a foot portion being attached to and extending away from said leg portion, said foot portion having a bend therein such that a free end of said foot portion extends upward, wherein said engaging member generally has a J-shaped configuration, said foot portion being selectively positionable in a retracted position located generally in a plane of said rod and said angled members and an extended position orientated generally perpendicular to said plane;

a biasing member for biasing said flange away from said lip, said biasing member comprising a spring positioned between said flange and said lip; and a pin being attached to said free end of said shaft, said pin being located such that it may extend into said hole when said engaging member is in said retracted position.

8. A combination mini-blind and clothes hanger device, said device comprising:

a hanger including a rod and a pair of angled members, each of said angled members having a first end attached to said rod and a second end attached together such that a loop is defined, a hook being rotatably attached to a juncture of said angled members and extending in a direction away from said rod; and a pair of hanging members for removably attaching to a mini-blind, each of said hanging members being attached to said rod, said hanging members being spaced from each other, each of said hanging members being adapted for swiveling with respect to said rod;

a shaft being attached to said rod and extending in a direction generally opposite of said angled members, a flange being attached to and extending around a free end of said shaft;

a saddle having first side, a second side and a peripheral wall extending between said first and second sides, a well extending into first side, said well having a bottom wall, a peripheral lip being attached to said first side and extending inward, said free end of said shaft being positioned in said well such that said flange is positioned between said lip and said bottom wall and said saddle is rotatably coupled to said shaft; and an engaging member being attached to and extending away from said saddle.

9. The combination mini-blind and clothes hanger device as in claim 8, further including a locking means for selectively locking said engaging member in a retracted position located generally within a plane of said rod and angled members.

10. The combination mini-blind and clothes hanger device as in claim 9, wherein said locking means includes:

said bottom wall of said well having a hole extending therein;

a biasing member for biasing said flange away from said lip; and a pin being attached to said free end of said shaft, said pin being located such that it may extend into said hole when said engaging member is in said retracted position.

11. The combination mini-blind and clothes hanger device as in claim 8, wherein said engaging member includes a leg portion being attached to said second side of said saddle, a foot portion being attached to and extending away from said leg portion, said foot portion having a bend therein such that a free end of said foot portion extends upward, wherein said engaging member generally has a J-shaped configuration, said foot portion being selectively positionable in a retracted position located generally in a plane of said rod and said angled members and an extended position orientated generally perpendicular to said plane.

12. The combination mini-blind and clothes hanger device as in claim 8, further including a biasing member for biasing said flange away from said lip.

13. The combination mini-blind and clothes hanger device as in claim 12, further including a pin being attached to said free end of said shaft, said pin being located such that it may extend into said hole when said engaging member is in a retracted position defined by said engaging member being generally located in a plane of said rod of and said angled members.

* * * * *